US005216888A

United States Patent [19]

Kupiszewski et al.

[11] Patent Number: 5,216,888

[45] Date of Patent: Jun. 8, 1993

[54] LOAD TRANSFER DEVICE FOR CRYOGENIC APPLICATION

[75] Inventors: Thomas Kupiszewski, Harrison City; David Marschik, Murrysville, both of Pa.

[73] Assignee: Westinghouse Electric Corp., Pittsburgh, Pa.

[21] Appl. No.: 828,830

[22] Filed: Jan. 31, 1992

[51] Int. Cl.[5] ..... F17C 1/00

[52] U.S. Cl. ..... 62/45.1; 165/169; 220/420; 220/426

[58] Field of Search ..... 62/45.1; 165/168, 169; 220/420, 426

[56] References Cited

U.S. PATENT DOCUMENTS

| | | | |
|---|---|---|---|
| 3,289,423 | 12/1966 | Berner et al. | 62/45.1 |
| 3,461,678 | 8/1969 | Klipping et al. | 220/421 |
| 3,668,880 | 6/1972 | Gille | 62/45.1 |
| 3,717,005 | 2/1973 | McGlew et al. | 62/45.1 |
| 3,930,375 | 1/1976 | Hofmann | 220/421 |
| 4,023,617 | 5/1977 | Carlson et al. | 62/45.1 |

*Primary Examiner*—Ronald C. Capossela
*Attorney, Agent, or Firm*—D. Schron

[57] ABSTRACT

A structural support for cryogenic apparatus used in a vacuum vessel includes a plurality of spaced parallel plate members having honeycomb structures interposed therebetween and joined to the plate members. The honeycomb structure provides for a plurality of cells which are the same pressure existing within the vacuum vessel by reason of apertures being provided in the plate members or cell structures. The apertures are arranged so that they are offset from plate-to-plate or cell-to-cell in order that there be no direct optical path from the top of the support structure to the bottom or from side-to-side.

10 Claims, 8 Drawing Sheets

LOAD TRANSFER DEVICE FOR CRYOGENIC APPLICATION

BACKGROUND OF THE INVENTION

Field of the Invention

The invention in general relates to supports, or the like, having high thermal impedance for use with cryogenic systems within a vacuum vessel.

Background Information

Superconducting, high power electrical equipment is generally contained within a cryogenic vacuum vessel in view of the requirement of low temperature operation, near absolute zero on the Kelvin scale. The equipment rests on supports which must be designed such that conductive and radiative heat transfer between the surrounding ambient medium and the cryogenic mass is reduced without sacrificing structural integrity.

Accordingly, a designer of a cryogenic support for use in a vacuum vessel is faced with mutually exclusive requirements of high strength, which would necessitate maximizing cross-sectional areas, and low heat leakage, which necessitates minimizing cross-sectional areas. The present invention provides a solution to this dilemma.

SUMMARY OF THE INVENTION

In accordance with the present invention there is provided a load transfer structure, such as a support for cryogenic application in a vacuum vessel. The structure includes a plurality of spaced, parallel plate members with a plurality of honeycomb structures, each interposed between respective ones of the plate members. The honeycomb structures are joined to adjacent ones of the plate members and have coefficients of thermal expansion similar to that of the plate members. Means that are provided for ensuring that the pressure within the honeycomb structures is maintained at the pressure existing within the vacuum vessel itself. In one embodiment the honeycomb structures are formed of a plurality of adjacent hollow cells, and the plate members or the cells themselves include apertures for pressure equalization.

DESCRIPTION OF THE PREFERRED EMBODIMENTS

Figure 1:
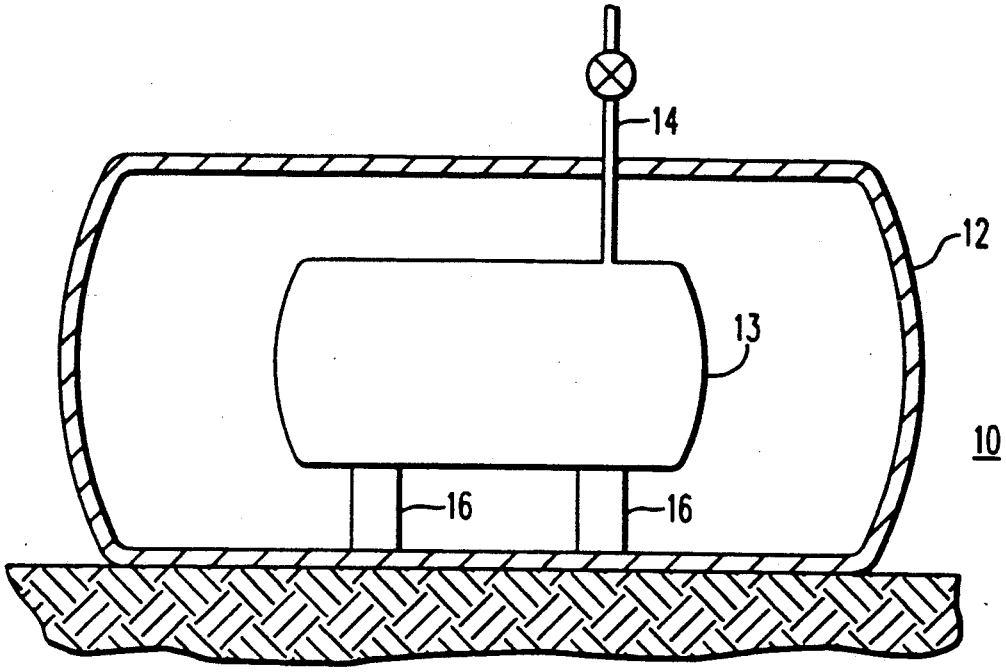
FIG. 1 is a view of a cryogenic vacuum vessel illustrating a support function of a load transfer device in accordance with the present invention.

Referring now to FIG. 1, there is illustrated cryogenic apparatus 10 including an outer vacuum vessel 12 and an inner cryogenic container 13. A valved piping arrangement 14 allows for cryogen coolant flow into or out of the container 13, which may be a cryogen coolant storage medium or which may contain electrical apparatus. Cryogenic container 13 rests on load transfer devices in the form of supports 16, which must be designed to support the weight of the container 13 and its contents while simultaneously providing a high heat impedance path between the cryogenic temperature of container 13 and the temperature of the surrounding ambient medium outside of vacuum vessel 12.

Figure 2:
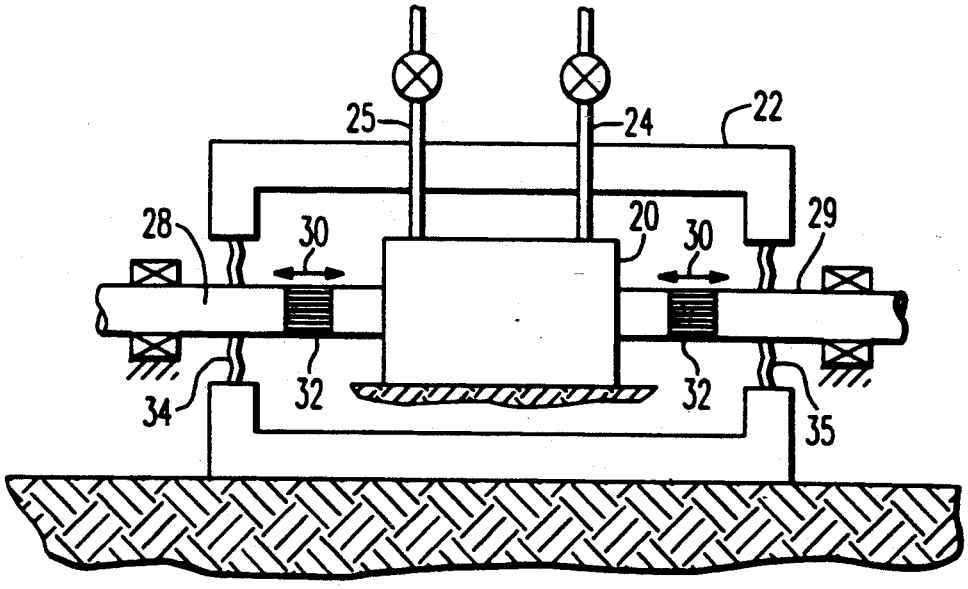
FIG. 2 illustrates a load transfer device for use in other than a support function.

Another use for the load transfer device is shown in FIG. 2 which illustrates a cryogenic linear motor 20 supported and housed within a vacuum vessel 22. Valved piping arrangements 24, 25 provide for cryogen coolant flow to and from the linear motor 20. During operation, supported shafts 28, 29 move in the direction as indicated by arrows 30 to activate one or more load devices (not illustrated).

In order to maintain cryogenic integrity, some sort of a heat flow barrier must be interposed in the arrangement, and the heat barrier takes the form of load transfer devices 32 in line with, and constituting part of, the shafts 28, 29. The load transfer devices in conjunction with vacuum seals 34, 35, ensure that a cryogenic operation will be maintained.

Figure 3:
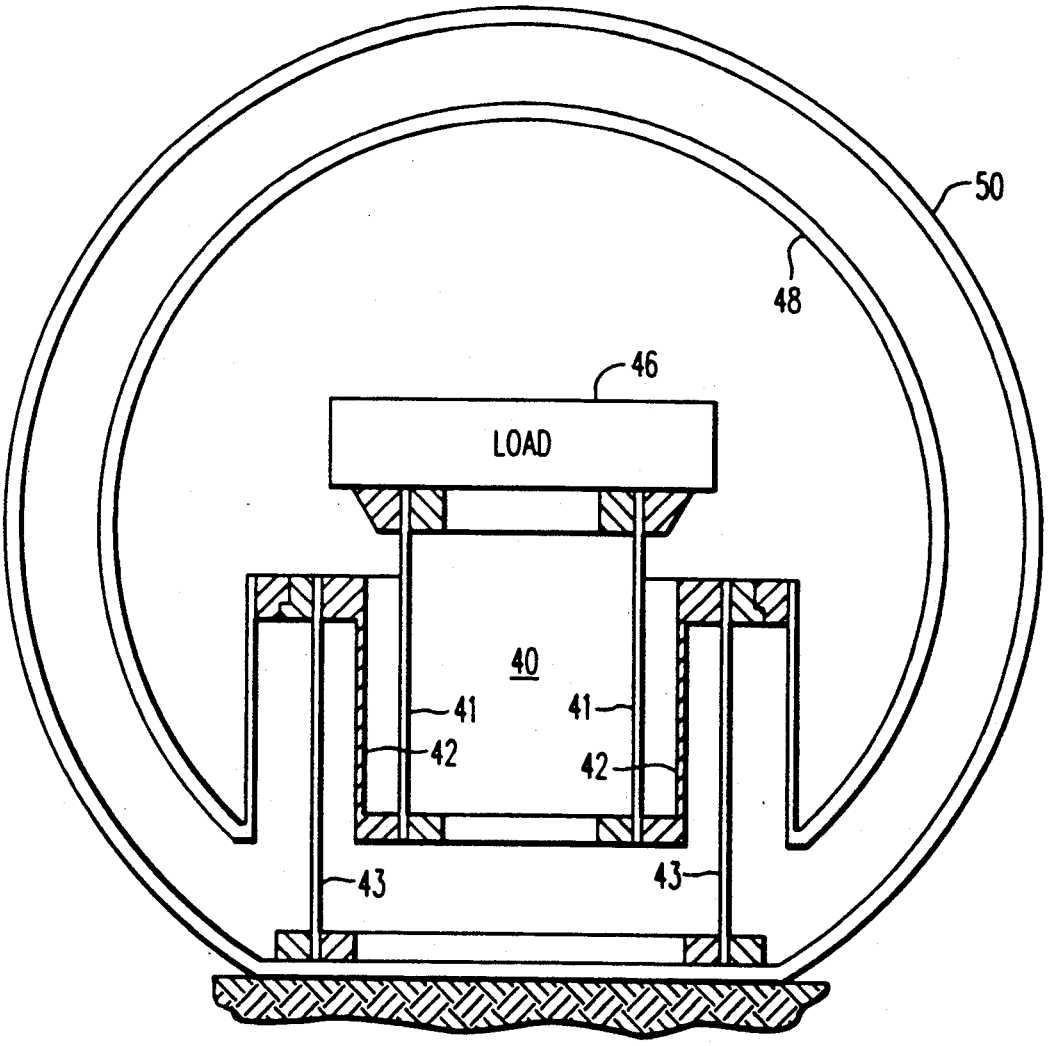
FIG. 3 PRIOR ART
FIG. 3 is a cross-sectional view of a prior art cryogenic support.

One of type of well-known cryogenic support is illustrated, in cross-sectional view, in FIG. 3. The reentrant support 40 is constructed from three concentric, thin-walled tubes 41, 42, 43 arranged to support a load 46 surrounded by a heat shield 48 and all contained within a vacuum vessel 50 for operation at cryogenic temperatures.

The support 40 must function to not only sustain the weight of load 46, but it must also function to minimize heat flow from the outside ambient environment, which may be at a temperature of 300K, to the cryogenic load, which may be at a temperature of 4K. Flanged inner tube 42 provides a transition between the top of the outer tube 43 and the bottom of the inner tube 41, such that the inner and outer tubes are loaded in compression while the transition tube 42 is loaded in tension.

The construction of support 40 limits its load-bearing capabilities in view of the fact that the support is not limited by the buckling strength of the tube, but by the shear strength of the tube-to-tube joints. Further, thermal impedance of the support is shunted by radiant heat transfer not only in the axial but also in the radial direction, which necessitates installation of a plurality of layers of insulation in regions between the concentric tube, thus significantly adding to the cost of such structure. Further, high joint strength requires very precise interference fits. The machining to achieve the high tolerances needed also significantly adds to the costs of these supports.

Figure 4:
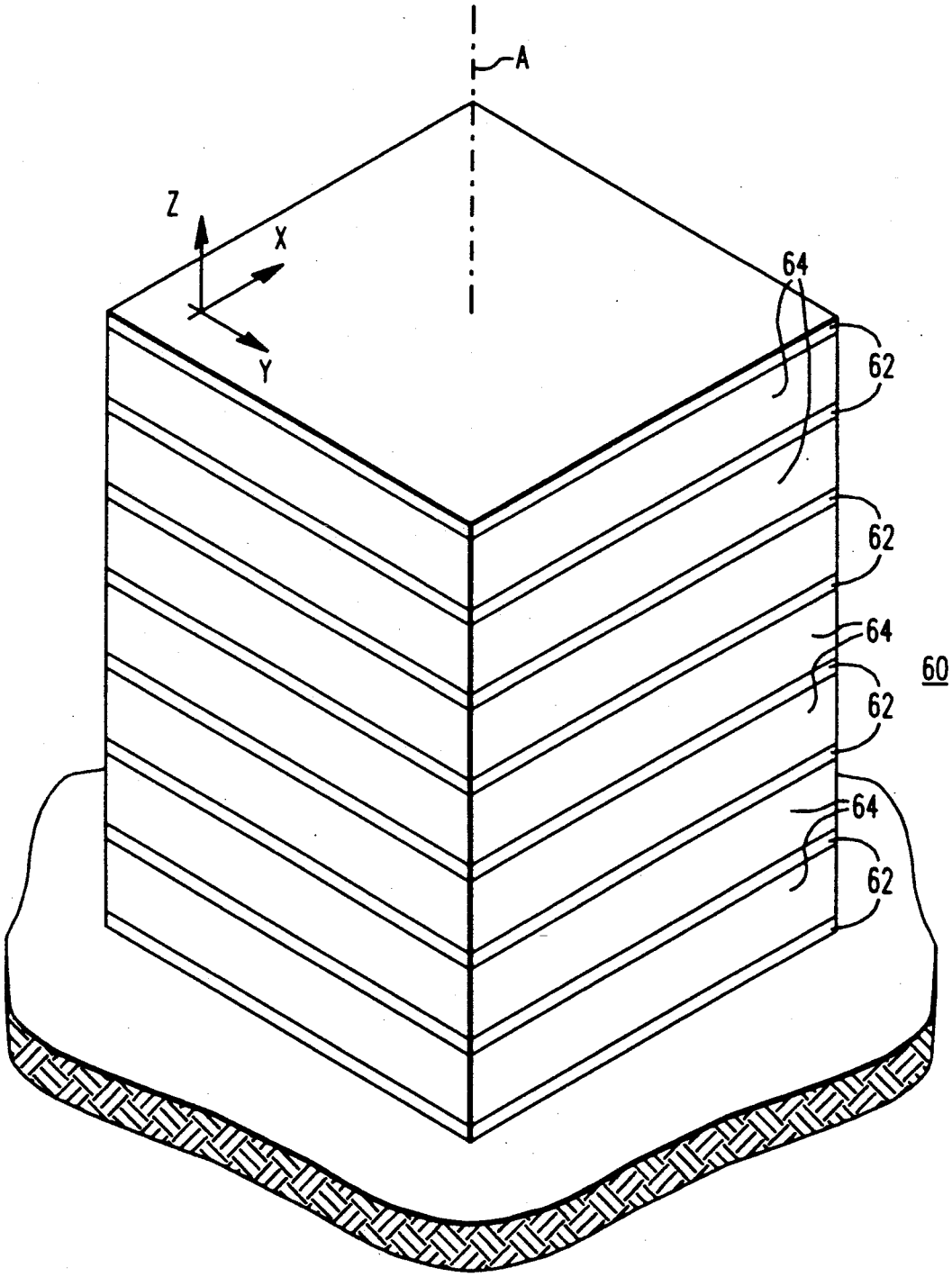
FIG. 4 is a view of a cryogenic support in accordance with one embodiment of the present invention.

In accordance with the present invention, a load transfer device in the form of a structure 60 is illustrated in FIG. 4. The structure, which extends along a central axis A, includes a plurality of spaced radiating shields in the form of parallel plate members 62. Interposed between respective ones of the plate members 62 are honeycomb structures 64 joined to adjacent ones of the plate members 62. The plate members 62 and honeycomb structures 64 are selected so that they have identical or substantially similar coefficients of thermal expansion in order to prevent fracture of the material during cool-downs of the systems in which the supports are utilized. The plates and honeycomb structures may be fabricated from a variety of materials such as aluminum alloys, stainless steel alloys, super alloys, titanium alloys, nylon, fiber glass, aramids, graphite/carbon composites or an epoxy glass laminate known as G10, by way of example.

With reference to the X, Y, Z coordinate system illustrated, the structure's central axis A is in the same direction as the Z axis, which is the direction of applied load during use. The Z direction, therefore, is the direction of high stiffness while the directions transverse thereto, that is, X, Y, will exhibit significantly lower stiffness.

The support 60 is constructed and arranged such that there is no direct optical corridor which extends through the plates 62 and honeycomb structure 64 in the Z direction, nor are there any unobstructed optical corridors through the honeycomb structures 64 in the X or Y directions or angular positions therebetween. The presence of an unobstructed optical corridor would objectionably present a low impedance path for heat leakage via radiative transfer.

Figure 5:
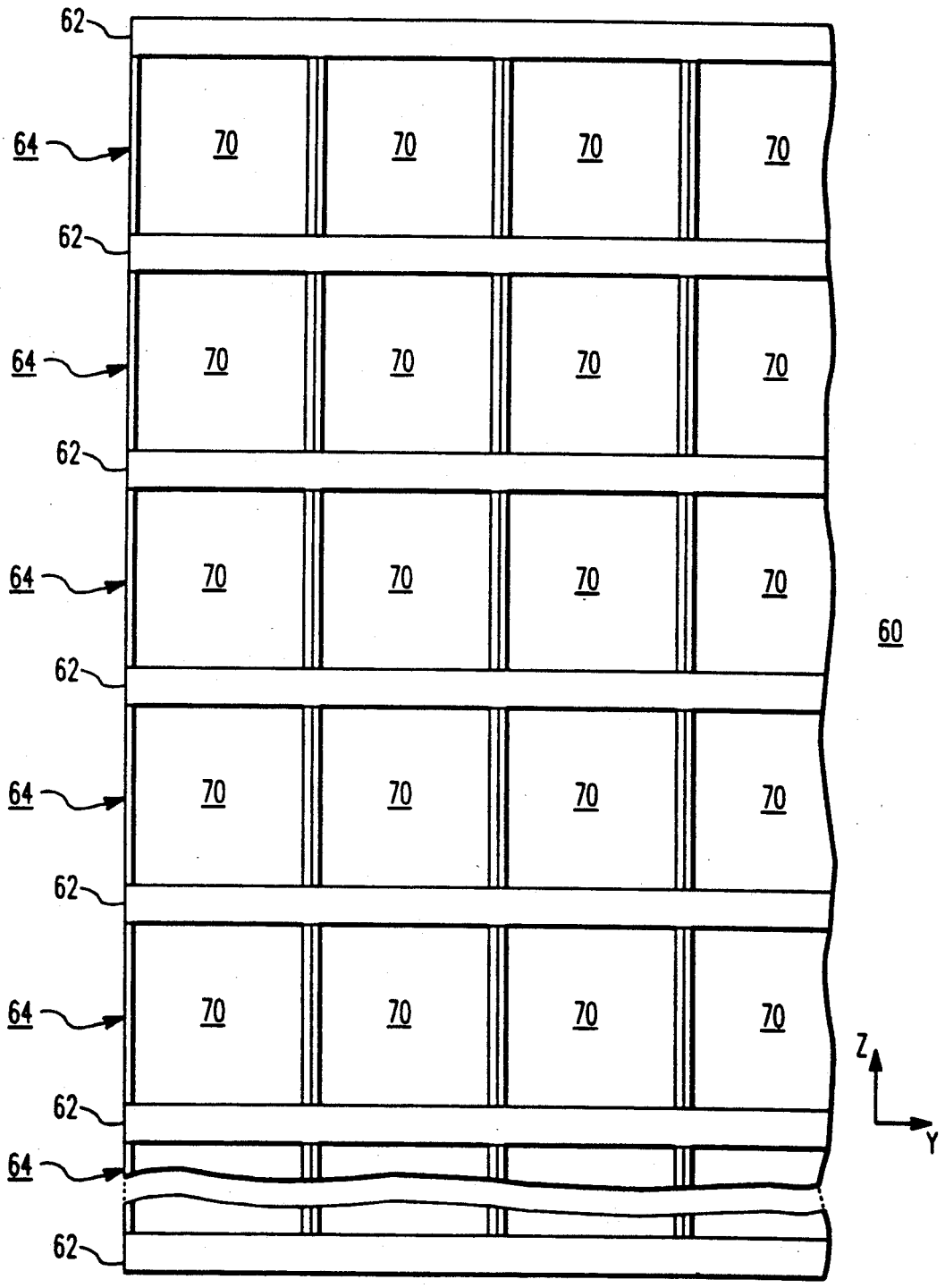
FIG. 5 is a somewhat more detailed view of the support of FIG. 4.

FIG. 5 illustrates the support 60 wherein the honeycomb structures 64 are comprised of a plurality of cylindrical tubes 70 which abut and are joined to one another in a particular honeycomb layer. The cutaway view of FIG. 6 illustrates the arrangement in somewhat more detail.

Figure 6:
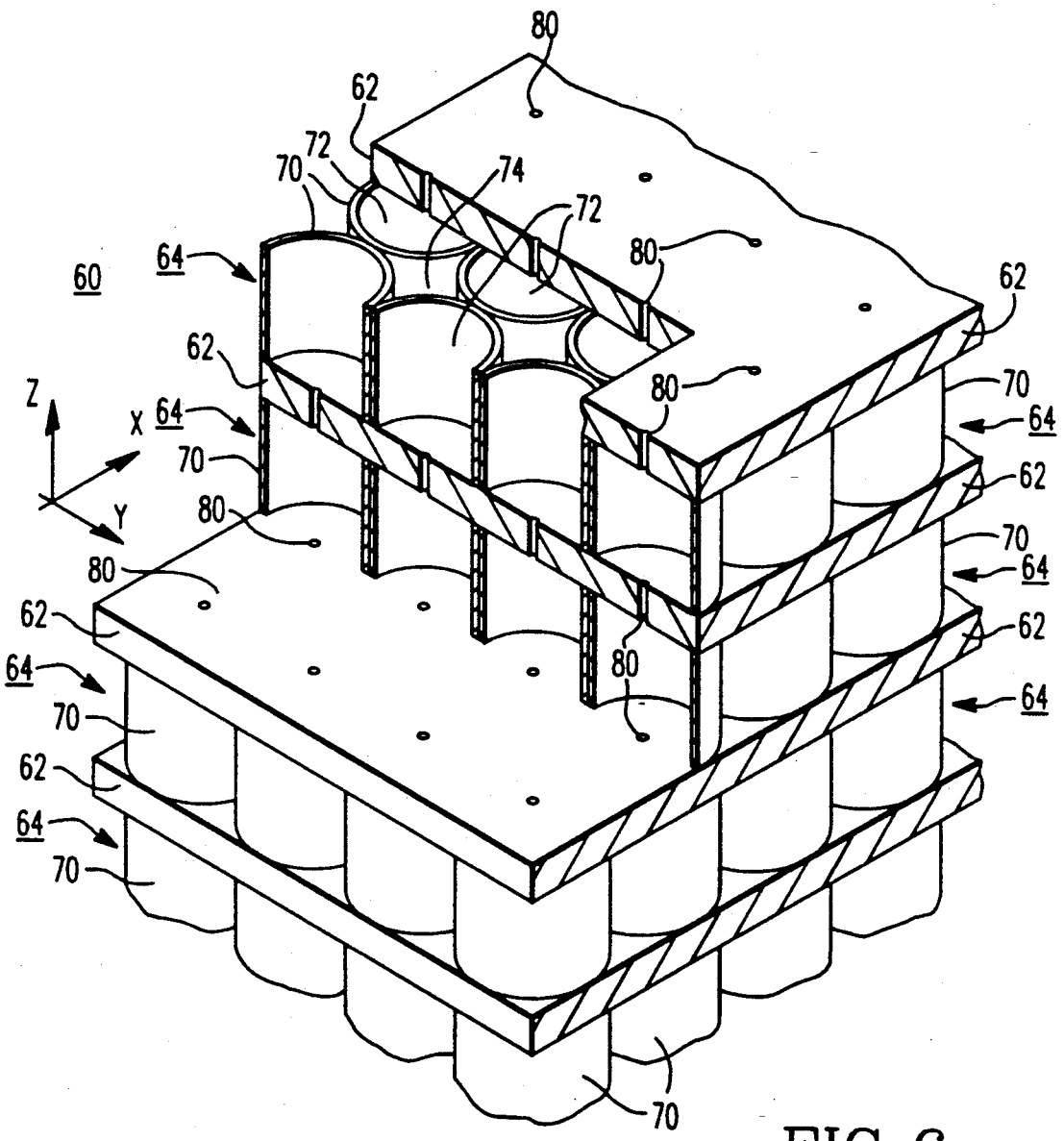
FIG. 6 is an isometric view with cutaway portions illustrating the support of FIG. 5 in more detail.

In the arrangement of FIG. 6, the cylindrical tubes 70 are joined to one another and to respective upper and lower plate members 62. Applicable joining processes for fabrication of metals into cryogenic support post-type structures are all prior art and include furnace brazing, electric blanket brazing, radiant heat brazing and adhesive bonding. Each of these systems have their own advantages and disadvantages depending on factors such as design, size, quantity and service requirements.

Plastics and composites with organic matrix are best joined with adhesive bonding. Adhesive bonding may be high bond strength film or thermally activated adhesive among others.

The honeycomb structure 64, therefore, is defined by a plurality of hollow cells constituted by the interiors 72 of cylindrical tubes 70, as well as by the volume 74 enclosed by the outside surfaces of four adjacent and touching cylindrical tubes 70.

The support is fabricated at atmospheric pressure and, accordingly, atmospheric pressure exists within the cells of the honeycomb structures 64. The support, however, is utilized in a vacuum vessel, and it is preferable that the cells of the honeycomb structures be evacuated so as to maintain the same pressure as that which exists within the vacuum vessel. Accordingly, in order to eliminate any stress-causing differential pressures and to negate heat leakage due to residual gas conduction, means are provided for ensuring that the pressure within the honeycomb structures is maintained at the pressure existing within the vacuum vessel. In order to accomplish this pressure equalization, in one embodiment, the plate members 62 have a plurality of apertures each extending from one side of the plate member 62 to the other side. These apertures 80 are strategically located above and below the individual cylindrical tubes 70 as well as the volumes 74 formed by the tubes.

Figure 7:
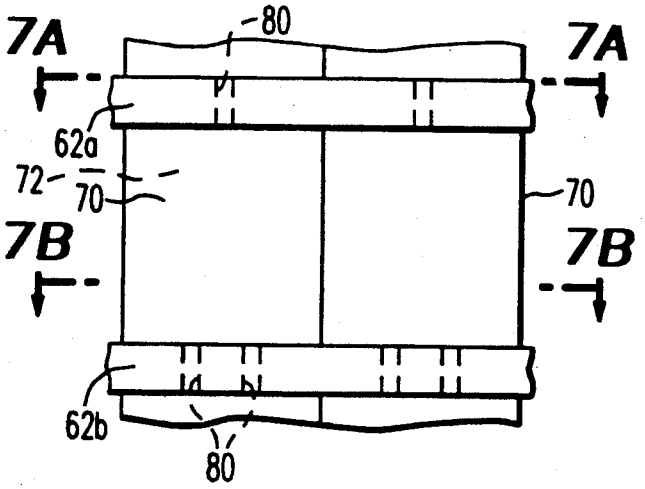
FIG. 7 is a side view of two adjacent cells of the support structure of FIG. 6.
Figure 7A:
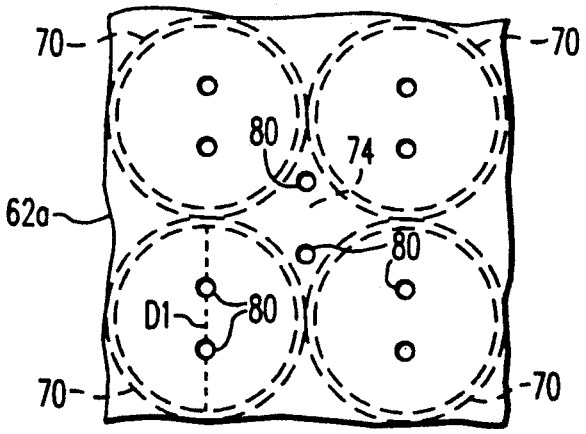
FIGS. 7A and 7B are respective views along lines A—A and B—B of FIG. 7.
Figure 7B:
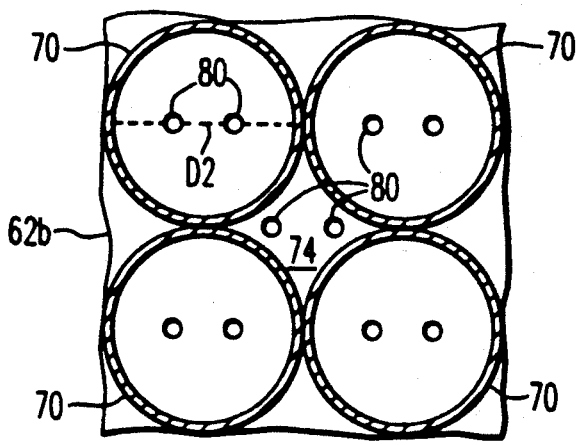

For evacuation of the cells of the honeycomb structure, FIG. 6 illustrates two apertures 80 per cylindrical tube 70, one on top and one on the bottom. A faster pressure equalization process may be accomplished by the arrangement illustrated in FIGS. 7, 7A, 7B. FIG. 7 illustrates two sequential plate members designated as **62*a*, 62*b* joined to cylindrical tubes 70. A plurality of apertures (two by way of example) is provided through the plate members for communication with the interior 72 of the cylindrical tube 70. As illustrated in FIG. 7A, which is a view along line A—A of FIG. 7, with the lower lefthand tube 70 taken as exemplary, two apertures 80 are provided in the plate member 62 and are aligned along a diameter D1. The opposite plurality of apertures 80, as illustrated in FIG. 7B, which is a view along line B—B of FIG. 7, are along a diameter D2 angularly displaced relative to diameter D1 of FIG. 7A. With this arrangement, as well as with the arrangement of FIG. 6**, the apertures do not line up axially. If they were lined up they would present an unobstructed optical corridor. The fact that there is no direct optical path through the support structure ensures that there is no low impedance path for heat leakage via radiative transfer.

Figure 8:
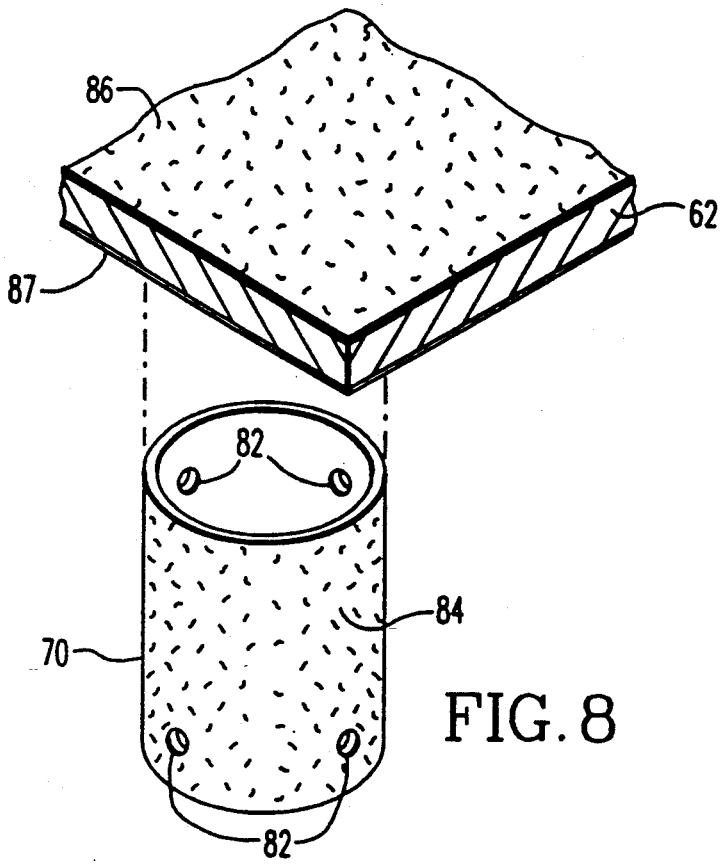
FIG. 8 is a view of a single cell of a honeycomb structure illustrating an alternative means of achieving pressure equalization.

FIG. 8 illustrates an alternate arrangement for equalizing pressure within a cylindrical tube 70 of the honeycomb structures. In FIG. 8 a typical plate member 62 does not include any apertures, but rather the cylindrical tube itself includes apertures 82 for the pressure equalization process. Apertures 82 are provided in the tube wall in a manner such that there is no unobstructed optical path from one side of the support structure to the other.

In addition, FIG. 8 illustrates an alternate embodiment whereby the thermal impedance of the structure may be greatly increased by the provision of an aluminized coating 84 on the outside surface of the cylindrical tube 70, as well as providing aluminized coatings on the top and bottom surfaces 86, 87 of each plate member 62.

Figure 9:
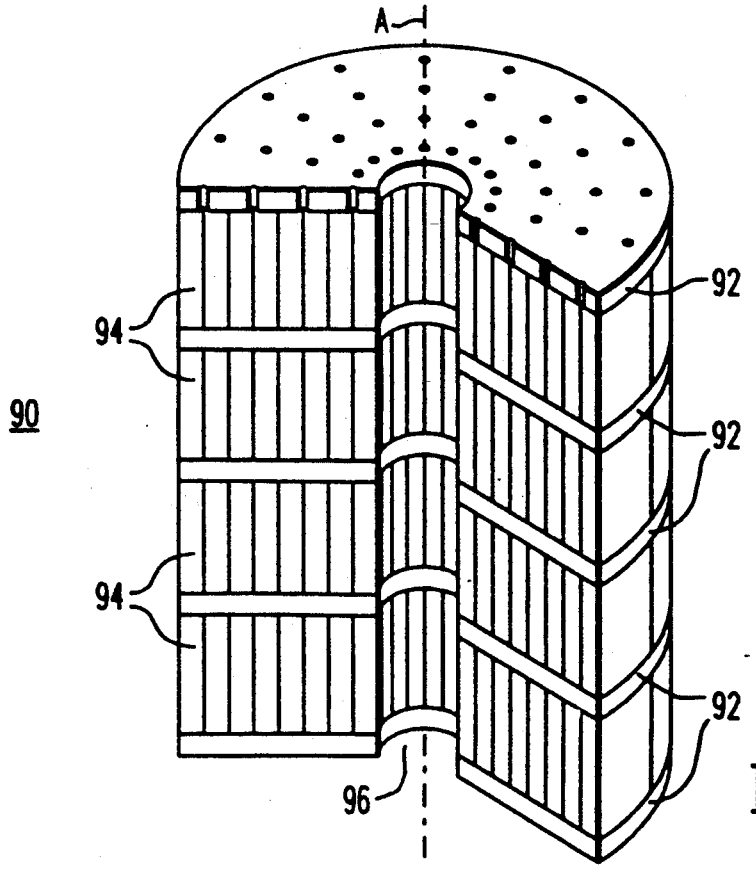
FIG. 9 illustrates a cylindrical support member in accordance with the present invention.

FIG. 9 illustrates a support structure 90, including a plurality of parallel apertured plate members sandwiching a plurality of honeycomb structures 94. The structure 90 includes a central aperture 96 extending along the central axis A for accommodation of a cryogen piping member during use in a vacuum vessel. The cylindrical support 90 may be made with disk-like plates 92 or it, as well as a variety of other shapes, may be machined from a basic structure 60 as depicted in FIG. 4.

Figure 10:
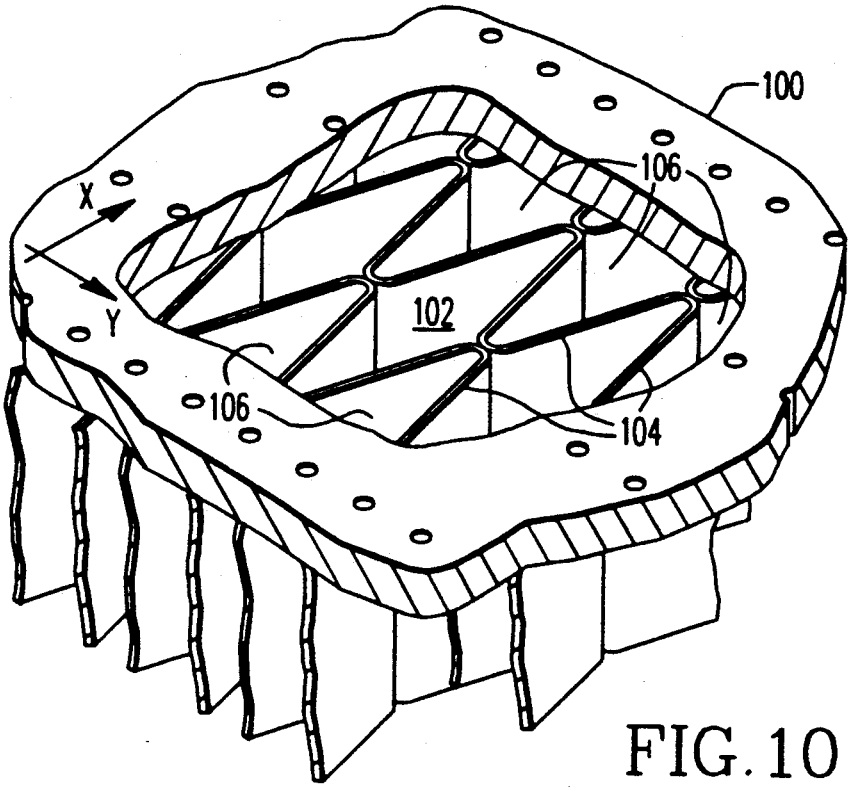
FIGS. 10 and 11 illustrate other embodiments of a honeycomb structure which may be utilized herein.

FIG. 10 illustrates a plan view of a plate member 100 which has a portion cut away to view the underlying honeycomb structure 102. Honeycomb structure is comprised of a plurality of undulating or serpentine walls 104 extending in the Y direction and joined at their respective peaks and valleys, as illustrated, to form a plurality of enclosed cells 106. The plate members such as member 100 therefor would be of the apertured variety so that pressure equalization may take place.

Figure 11:
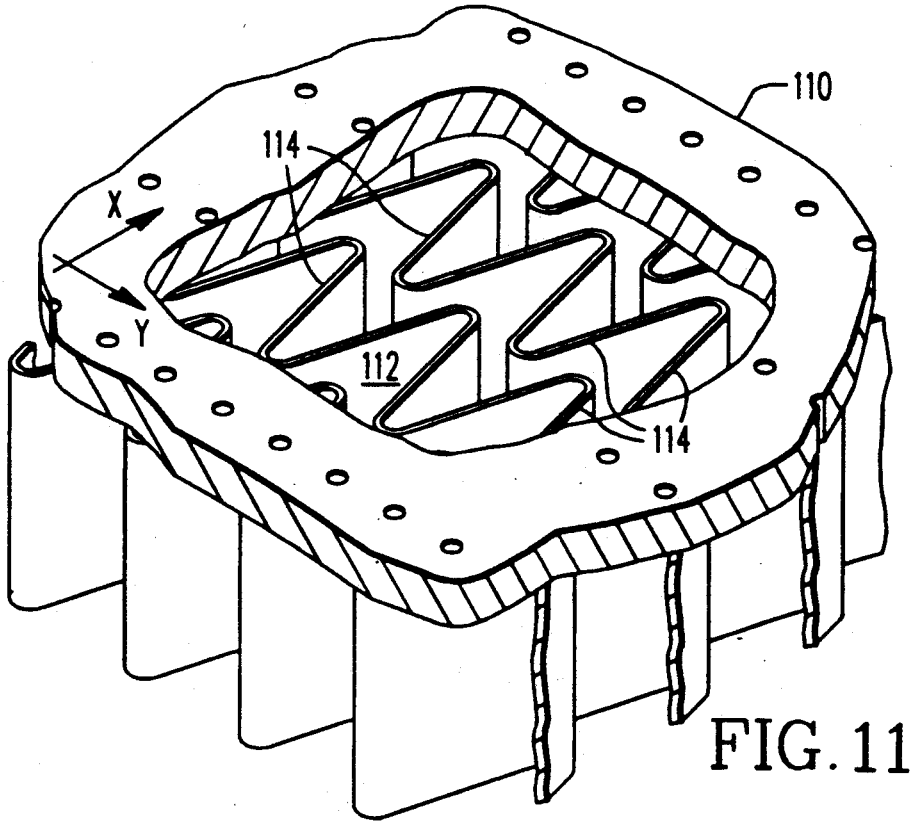

As an alternative, and as illustrated in FIG. 11, plate member 110 has a cutaway portion illustrating the underlying honeycomb structure 112 made up of a plurality of undulating or serpentine wall members 114 extending in the Y direction. The serpentine wall members, however, are not joined to one another, but are positioned and attached to the respective plate members such that adjacent peaks and valleys overlap somewhat, as illustrated, so that no unobstructed optical corridor for heat leakage via radiative transfer is presented in any direction, including the Y direction. This arrangement has the advantage of enhanced flow conductance for reducing vacuum pump-down time of the support structure.

We claim:

1. A load transfer structure for cryogenic application in a vacuum vessel, comprising:

a) a plurality of spaced, parallel plate members;

b) a plurality of honeycomb structures, each interposed between respective ones of said plate members;

c) said honeycomb structures being joined to adjacent ones of said plate members;

d) said plate members and said honeycomb structures having substantially similar coefficients of thermal expansion; and e) means for ensuring that the pressure within said honeycomb structures is maintained at the pressure existing within said vacuum vessel.

2. A load transfer structure according to claim 1 wherein:

a) said honeycomb structure is comprised of a plurality of serpentine wall sections.

3. A load transfer structure according to claim 1 wherein:

a) said parallel plate members include an aluminized coating thereon.

4. A load transfer structure according to claim 1 wherein:

a) said honeycomb structures include an aluminized coating thereon.

5. A load transfer structure for cryogenic application in a vacuum vessel, comprising:

a) a plurality of spaced, parallel plate members;

b) a plurality of honeycomb structures, each interposed between respective ones of said plate members, and each including a plurality of adjacent hollow cells;

c) said honeycomb structures being joined to adjacent ones of said plate members;

d) said plate members and said honeycomb structures having substantially similar coefficients of thermal expansion; and e) means for ensuring that the pressure within said cells is maintained at the pressure existing within said vacuum vessel.

6. A load transfer structure according to claim 5 wherein:

a) said plurality of plate members include a plurality of apertures therethrough communicative with the interiors of said cells in a manner that the interiors of said cells may be maintained at the pressure existing within said vacuum vessel.

7. A load transfer structure according to claim 6 wherein:

a) said apertures in adjacent plate members do not line up with one another.

8. A load transfer structure according to claim 5 wherein:

a) each said honeycomb structure is comprised of a plurality of cylindrical tubes.

9. A structure according to claim 5 wherein:

a) the thickness of a said plate member is greater than the thickness of the wall of a said cylindrical tube.

10. A load transfer structure according to claim 8 wherein:

a) each said cylindrical tube includes at least one aperture in the wall thereof.

* * * * *